US007582266B2

(12) United States Patent
Brück

(10) Patent No.: US 7,582,266 B2
(45) Date of Patent: Sep. 1, 2009

(54) HONEYCOMB BODY, EXHAUST SYSTEM HAVING THE HONEYCOMB BODY AND METHOD FOR MUFFLING SOUND IN THE EXHAUST SYSTEM OF AN INTERNAL COMBUSTION ENGINE

(75) Inventor: Rolf Brück, Bergisch Gladbach (DE)

(73) Assignee: Emitec Gesellschaft fuer Emissionstechnologies mbH, Lohmar (DE)

( * ) Notice: Subject to any disclaimer, the term of this patent is extended or adjusted under 35 U.S.C. 154(b) by 834 days.

(21) Appl. No.: 10/845,663

(22) Filed: May 14, 2004

(65) Prior Publication Data

US 2004/0208803 A1 Oct. 21, 2004

Related U.S. Application Data

(63) Continuation of application No. PCT/EP02/14229, filed on Dec. 13, 2002.

(30) Foreign Application Priority Data

Dec. 17, 2001 (DE) ..... 101 62 161

(51) Int. Cl.
*B01D 50/00* (2006.01)
*B01D 39/06* (2006.01)

(52) U.S. Cl. ..... 422/180; 55/523

(58) Field of Classification Search ..... 422/171, 422/177, 180; 502/527.19, 439; 55/523
See application file for complete search history.

(56) References Cited

U.S. PATENT DOCUMENTS 3,325,256 A 6/1967 Calvert
4,007,908 A 2/1977 Smagghe et al.
4,832,998 A 5/1989 Cyron
5,105,539 A 4/1992 Maus et al.
5,157,010 A 10/1992 Maus et al.
5,506,028 A 4/1996 Brück
5,645,803 A 7/1997 Steenackers et al.
6,035,964 A 3/2000 Lange
6,277,784 B1 * 8/2001 Kruse ..... 502/439

(Continued)

FOREIGN PATENT DOCUMENTS

DE 41 04 637 A1 8/1991

(Continued)

*Primary Examiner*—Tom Duong
(74) *Attorney, Agent, or Firm*—Laurence A. Greenberg; Werner H. Stemer; Ralph E. Locher

(57) ABSTRACT

A honeycomb body for an exhaust system of an internal combustion engine has an axial length and channels which are substantially separated from each other and through which an exhaust gas can flow. The honeycomb body includes at least one first and one second subset of channels. At least the cross-sectional areas of one of the subsets of channels differs along the axial length of the honeycomb body, so that a transient time of the exhaust gas in the different subsets of channels is different. The difference in transient time of the exhaust gas between the different subsets of channels can be used for damping sound waves having one or more wavelengths, so that noise is reduced in the exhaust system in order to purify the exhaust gas without needing additional components in the exhaust system. An exhaust system and a method for muffling sound therein are also provided.

33 Claims, 3 Drawing Sheets

U.S. PATENT DOCUMENTS

| | | | |
|---|---|---|---|
| 6,316,121 | B1 | 11/2001 | Maus |
| 6,613,446 | B1 | 9/2003 | Peters et al. |

FOREIGN PATENT DOCUMENTS

| | | | | |
|---|---|---|---|---|
| DE | 42 17 632 | A1 | | 5/1993 |
| EP | 0 245 737 | B1 | | 11/1987 |
| EP | 0 430 945 | B1 | | 6/1991 |
| FR | 2789327 | A1 | * | 8/2000 |
| JP | 63-183326 | U | | 11/1988 |
| JP | 8-80422 | A | | 3/1996 |
| WO | 90/08249 | | | 7/1990 |
| WO | 99/31362 | | | 6/1999 |
| WO | 99/56010 | | | 11/1999 |

* cited by examiner

HONEYCOMB BODY, EXHAUST SYSTEM HAVING THE HONEYCOMB BODY AND METHOD FOR MUFFLING SOUND IN THE EXHAUST SYSTEM OF AN INTERNAL COMBUSTION ENGINE

CROSS-REFERENCE TO RELATED APPLICATION

This application is a continuation, under 35 U.S.C. § 120, of copending International Application PCT/EP02/14229, filed Dec. 13, 2002, which designated the United States; this application also claims the priority, under 35 U.S.C. § 119, of German Patent Application 101 62 161.2, filed Dec. 17, 2001; the prior applications are herewith incorporated by reference in their entirety.

BACKGROUND OF THE INVENTION

Field of the Invention

The invention relates to a device for muffling sound in the exhaust system of an internal combustion engine. A device of that type is used, for example, to attenuate one or more frequencies which are particularly critical for the internal combustion engine or an automobile, for example, which it is used to operate. More particularly, the invention relates to a honeycomb body, an exhaust system having the honeycomb body and a method for muffling or damping sound in the exhaust system of an internal combustion engine.

Numerous devices and methods for muffling or damping sound are known in the automotive industry. In that context, it is often necessary to attenuate particularly critical frequencies which lead, for example, to resonance in parts of the automobile. In some cases very complex structural measures are taken for that purpose. In particular, additional components are often required.

SUMMARY OF THE INVENTION

It is accordingly an object of the invention to provide a honeycomb body, an exhaust system having the honeycomb body and a method for muffling sound in the exhaust system of an internal combustion engine, which overcome the hereinafore-mentioned disadvantages of the heretofore-known devices and methods of this general type and which allow sound muffling in particular for especially critical frequencies, for exhaust gas purification or cleaning, substantially without the need for additional components.

A basic construction of honeycomb bodies of this type is known, for example, from European Patent 0 245 737 B1, corresponding to U.S. Pat. No. 4,832,998 or European Patent 0 430 945 B1, corresponding to U.S. Pat. No. 5,105,539. However, the invention can also be realized in other structural forms, for example helically round structural forms. Structural forms which are conical in one direction are also known, for example from International Publication No. WO 99/56010, corresponding to U.S. Pat. No. 6,613,446 B1. The production processes which are known for honeycomb bodies can also be employed for the present invention. Recent developments relating to cell geometry have promoted the use of microstructures in the channel walls, as are known, for example, from International Publication No. WO 90/08249, corresponding to U.S. Pat. No. 5,157,010 and International Publication No. WO 99/31362, corresponding to U.S. Pat. No. 6,316,121 B1. These developments can also be applied in addition for the present invention. In general, known methods for producing or improving the efficiency of honeycomb bodies of this type can also be applied to the present invention.

With the foregoing and other objects in view there is provided, in accordance with the invention, a honeycomb body for an exhaust system of an internal combustion engine. The honeycomb body comprises an axial length and channels through which exhaust gas can flow. The channels are substantially separate from one another. The channels include at least a first subset or group of channels and a second subset or group of channels. At least one of the subsets of channels has cross-sectional areas changing over the axial length, causing a transient or propagation time of the exhaust gas to be different in the first and second subsets of channels.

It is expedient to use a honeycomb body for sound muffling in the exhaust system of an internal combustion engine, since bodies of this type are already in widespread use, for example in catalytic converters for exhaust gas purification, and are therefore already present in the exhaust system of an automobile. This makes it possible to reduce sound levels in the exhaust system without further components having to be introduced into the exhaust system. The result, therefore, is a structurally simple and inexpensive way of muffling sound.

In a channel with a change in cross-sectional area, the velocity of a gas stream is inversely proportional to the cross-sectional area. Accordingly, the gas stream is decelerated when the cross-sectional area of the channel increases over the axial length of the honeycomb body. Conversely, the gas stream is accelerated if the cross-sectional area of the channel decreases over the axial length of the honeycomb body. According to the invention, an exhaust-gas stream which enters the honeycomb body is separated into at least two partial quantities of exhaust gas which each flow passing through one subset of channels. If the honeycomb body has an axial length L in a main direction of flow z, the transient time t(L) of a gas with a velocity v, which is dependent on z, can be calculated as follows:

$$t(L) = \frac{L}{\int_0^L dz \frac{\partial v}{\partial z}}$$

Since, therefore, the velocity function v(z) can be influenced by the change in the cross-sectional area of the channel and the transient time of a gas through a channel is dependent firstly on the length of the channel and secondly on the velocity function which applies in the channel, the transient time of an exhaust gas in a channel can be adjusted with very high levels of accuracy.

When this principle is applied to the two subsets of channels, the result is the possibility according to the invention of producing a transient time difference between the partial quantities of exhaust gas flowing through the two subsets of channels. If the exhaust gas is a carrier of sound waves, it is possible to bring about a phase difference between the sound waves in the two subsets of channels through the use of this difference in transient time. If the difference in transient time is selected appropriately, this leads to attenuation of sound waves of a defined wavelength.

Should it be desired to attenuate sound waves of a wavelength $\lambda$, a phase velocity c and an angular frequency $\omega$, it is preferable to select as the transient time difference between a transient time $t_1$ of the first partial quantity of exhaust gas through the first subset of channels and a transient time $t_2$ of the second partial quantity of exhaust gas through the second subset of channels:

$$|t_1 - t_2| = \frac{2n+1}{2}\frac{\lambda}{c},$$

where n is a natural number.

In accordance with another feature of the invention, the first subset of channels in each case has a first inlet cross-sectional area and a first outlet cross-sectional area, and the second subset of channels over its axial length in each case has a second inlet cross-sectional area and a second outlet cross-sectional area. The ratio of the first inlet cross-sectional area to the first outlet cross-sectional area is different than the ratio of the second inlet cross-sectional area to the second outlet cross-sectional area. In this case, therefore, the cross-sectional areas of the first subsets of channels and of the second subsets of channels change in different ways. This requires a change in velocity in both partial quantities of exhaust gas which flow through the two subsets of channels and consequently a transient time difference.

In accordance with a further feature of the invention, the cross-sectional area of at least one subset of channels increases, preferably increases in monotone fashion and particularly preferably increases in strictly monotone fashion, in the main direction of flow z and/or the cross-sectional area of another subset of channels decreases, preferably decreases in monotone fashion and particularly preferably decreases in strictly monotone fashion, in the main direction of flow. In monotone fashion means that it is quite possible for part of a channel or even the entire channel to have the same cross-sectional area over the axial length L. This is not possible in the case of profiles which are strictly monotone; in this case, there must be a constant increase or decrease in the cross-sectional area over the axial length.

In accordance with an added feature of the invention, at least one subset of channels widens conically and/or at least one further subset of channels narrows conically. Therefore, according to the invention it is possible for the cross-sectional area of a first subset of channels not to change over the axial length, while a second subset widens or narrows conically, or also for the cross-sectional area to increase or decrease in monotone fashion in the main direction of flow z in some other way. According to the invention, it is also possible for a first subset of channels to widen conically, whereas a second subset of channels narrows conically. This allows a honeycomb body according to the invention to have a very simple structural configuration.

In accordance with an additional feature of the invention, the subsets of channels are configured in such a way that different subsets of channels have different integrals of the cross-sectional areas over the axial length. This advantageously enables the channels to be provided with chambers, widened sections and narrowed sections and in this way to take different requirements into account, for example with regard to the required pressure losses and cross sections of flow, as well as structural conditions or restrictions. It is also possible to produce considerable differences in transient time over relatively short axial lengths L.

With the objects of the invention in view, there is also provided an exhaust system of an internal combustion engine. The exhaust system comprises at least one honeycomb body having channels through which exhaust gas can flow and having an axial length. The channels include a first subset of channels and a second subset of channels. The first subset of channels forms or defines a flow path for a first partial quantity of the exhaust gas, and the second subset of channels forms or defines a flow path for a second partial quantity of the exhaust gas. At least one of the first and second subsets of channels has cross-sectional areas changing over the axial length of the at least one honeycomb body, causing a transient time of the exhaust gas to be different in the first and second subsets of channels. In this case too, by suitable dimensioning of the subsets of channels it is possible to bring about attenuation of at least one frequency of a sound wave in the exhaust gas.

In accordance with another feature of the invention, in this context, it is particularly preferable if the first subset of channels in each case has a first inlet cross-sectional area and a first outlet cross-sectional area, and the second subset of channels in each case has a second inlet cross-sectional area and a second outlet cross-sectional area, and the ratio of the first inlet cross-sectional area to the first outlet cross-sectional area is different than the ratio of the second inlet cross-sectional area to the second outlet cross-sectional area.

In accordance with a further feature of the invention, the cross-sectional area of at least one subset of channels increases, preferably increases in monotone fashion and particularly preferably increases in strictly monotone fashion, in the main direction of flow z and/or the cross-sectional area of at least one further subset of channels decreases, preferably decreases in monotone fashion and particularly preferably decreases in strictly monotone fashion, in the main direction of flow z. In this context, the term in a monotone fashion means that the cross-sectional area of part of a channel or even of an entire channel does not have to change, but it is not possible, for example, for a channel initially to widen before subsequently narrowing again. By contrast, the term increasing in a strictly monotone fashion means that at each coordinate z in the main direction of flow there are different cross-sectional areas which increase as the coordinate z increases, i.e. there is a continuous increase in size. A corresponding statement applies to a profile which decreases in monotone or strictly monotone fashion.

In accordance with an added feature of the invention, in this context, at least one subset of channels of the at least one honeycomb body widens conically and/or at least one further subset of channels narrows conically. Therefore, it is possible for a first subset of channels to widen or narrow conically, whereas the cross-sectional area of a second subset of channels does not change over the axial length. It is also possible for a first subset of channels to conically widen whereas a second subset of channels conically narrows. This advantageously allows a structurally simple configuration of the exhaust system. It is not only conical changes in cross-sectional area that are possible in the main direction of flow z, but rather any monotone change in cross-sectional area is possible and in accordance with the invention.

In accordance with an additional feature of the invention, different subsystems of channels have different integrals of the cross-sectional areas over the axial length L. This makes it possible to form, for example, chambers, widened sections and narrowed sections which make it possible to achieve good sound muffling despite, for example, existing design restrictions.

With the objects of the invention in view, there is additionally provided a method for muffling or damping sound in an exhaust system of an internal combustion engine. The method comprises providing the exhaust system with at least one honeycomb body having an axial length and having first and second subsets of channels through which the exhaust gas can flow. A first partial quantity of the exhaust gas is passed through the first subset of channels and a second partial quantity of the exhaust gas is passed through the second subset of channels. At least one of the first and second subsets of channels is provided with cross-sectional areas changing over the axial length of the honeycomb body, resulting in a difference in transient time of the exhaust gas in the first and second subsets of channels. The partial quantities of the exhaust gas are combined again downstream of the at least one honeycomb body. This method according to the invention allows at least sound waves of a defined frequency which are present in the exhaust gas to be attenuated.

In accordance with another mode of the invention, the first subset of channels in each case has a first inlet cross-sectional area and a first outlet cross-sectional area, while the second subset of channels in each case has a second inlet cross-sectional area and a second outlet cross-sectional area. The ratio of the first inlet cross-sectional area to the first outlet cross-sectional area is different than the ratio of the second inlet cross-sectional area to the second outlet cross-sectional area. In this context, it is particularly advantageous for the cross-sectional area of at least one subset of channels to increase, preferably to increase in monotone fashion, and particularly preferably to increase in strictly monotone fashion, in the main direction of flow z, whereas the cross-sectional area of a further subset of channels, alternatively or in addition, decreases, preferably decreases in monotone fashion and particularly preferably decreases in strictly monotone fashion. This allows the sound muffling method to be carried out in an advantageously simple way.

In accordance with a further mode of the invention, the exhaust gas flows through at least one honeycomb body which has at least one subset of channels that widens conically and/or at least one further subset of channels which narrows conically. This simplifies the calculation and adjustment of the difference in transient time.

In accordance with an added mode of the invention, the exhaust gas flows through different subsets of channels which have a different integral of the cross-sectional area over the axial length. By way of example, this allows the method to be carried out even, for example, under difficult geometric conditions and restrictions.

In accordance with an additional mode of the invention, the difference in transient time of the partial quantities of the exhaust gas is selected to be precisely such that when the at least two partial quantities are combined, there is at least in part a destructive interference for at least one frequency. For this purpose, the difference in transient time between the transient time of the first partial quantity of exhaust gas and the transient time of the second quantity of exhaust gas for sound waves of angular frequency ω, wavelength λ and phase velocity c is set to be exactly such that:

$$|t_1 - t_2| = \frac{2n+1}{2}\frac{\lambda}{c},$$

with natural numbers n applies. This requires a further phase factor in the wave equation, which for amplitudes $A_1$ in the first partial quantity of exhaust gas and $A_2$ in the second partial quantity of exhaust gas can then be presented as follows:

$$\phi(z)=\exp(i\omega t_1+ikz)[A_1+A_2\exp(-i(2n+1)\pi)]$$

The amplitudes $A_1$ and $A_2$ can be adjusted through the use of the ratio of a first inlet cross-sectional area of the first subset of channels to the second inlet cross-sectional area of the second subset of channels. If these two amplitudes $A_1$ and $A_2$ are precisely equal, the wave of annular frequency ω is completely eliminated. Destructive interference is present.

However, if the amplitudes $A_1$ of the first partial quantity of exhaust gas and $A_2$ of the second partial quantity of exhaust gas are not identical, there is in any event an attenuation of the sound wave and of corresponding harmonics.

In accordance with yet another mode of the invention, the destructive interference is formed precisely for one critical frequency. This allows the attenuation of frequencies which, for example, are critical for the internal combustion engine itself or also for the automobile which it is used to drive. By way of example, this may be a frequency at which resonance effects occur. Such effects are generally undesirable, since they represent an increased loading on material.

In accordance with a concomitant mode of the invention, the transient time difference between the partial quantities of the exhaust gas is selected in such a way that when the at least two partial quantities are combined there is at least in part a destructive interference for at least two frequencies. This advantageously enables a plurality of critical frequencies to be attenuated.

Other features which are considered as characteristic for the invention are set forth in the appended claims.

Although the invention is illustrated and described herein as embodied in a honeycomb body, an exhaust system having the honeycomb body and a method for muffling sound in the exhaust system of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
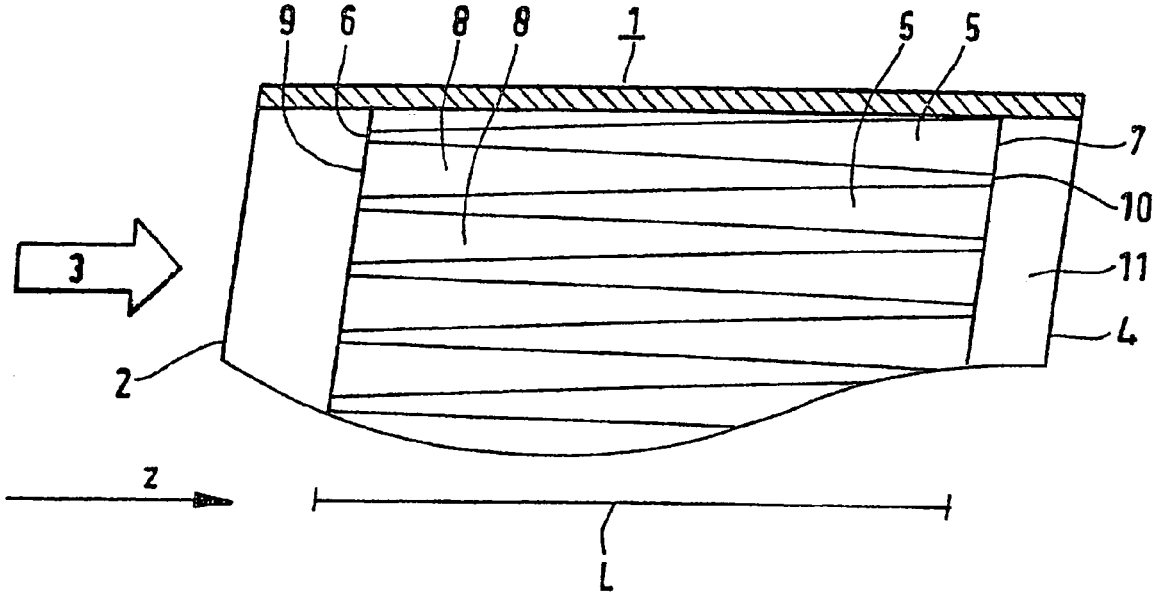
FIG. 1 is a diagrammatic, longitudinal-sectional view of a channel system of a honeycomb body according to the invention.

Referring now to the figures of the drawings in detail and first, particularly, to FIG. 1 thereof, there is seen a diagrammatic illustration of part of a honeycomb body 1 according to the invention in a longitudinal section. An exhaust-gas stream 3 flows into the honeycomb body 1 through an inlet side 2 and leaves the honeycomb body 1 through an outlet side 4. The honeycomb body includes two subsets of channels which differ by virtue of a change in channel cross-sectional area over an axial length L of the channels. The first subset of channels includes widening channels 5, which have a first inlet cross-sectional area 6, facing the inlet side 2, and a larger first outlet cross-sectional area 7 facing the outlet 4 of the honeycomb body 1. The second subset of channels includes narrowing channels 8 which have a second inlet cross-sectional area 9, facing the inlet side 2, and a smaller, second outlet cross-sectional area 10 facing the outlet side 4 of the honeycomb body 1. In this example, on one hand the first inlet cross-sectional area 6 corresponds to the second outlet cross-sectional area 10, and on the other hand the second inlet cross-sectional area 9 corresponds to the first outlet cross-sectional area 7. Therefore, a ratio formed from the first inlet cross-sectional area 6 and the first outlet cross-sectional area 7 is the reciprocal of a ratio formed from the second inlet cross-sectional area 9 and the second outlet cross-sectional area 10.

In each of the channels 5 and 8, the change in cross-sectional area is strictly monotone. The number of channels in the two subsets of channels is equal. A first partial quantity of exhaust gas flows through the first subset of channels, and a second partial quantity of exhaust gas, forming the other half, flows through the second subset of channels. The two partial quantities of exhaust gas are mixed in a mixing zone 11 downstream of the two subsets of channels and leave the honeycomb body 1 through the outlet side 4.

If the exhaust-gas stream 3 contains sound waves of wavelength $\lambda$ and phase velocity c, in general the intensity of the sound waves on flowing out through the outlet side 4 of the honeycomb body 1 will differ from the intensity on flowing into the honeycomb body 1. The velocity of each of the two partial gas streams changes as a result of the change in the channel cross-sectional areas. In the case of the example under consideration herein, there is an inversely proportional relationship between a velocity v of the gas in a main direction of flow z and the cross-sectional area through which the gas flows. Accordingly, the first partial quantity of exhaust gas is decelerated in the widening channels 5, whereas the second partial quantity of exhaust gas is accelerated in the narrowing channels 8. In the case of each of the two partial quantities of exhaust gas, the velocity changes continuously during the flow through the two subsets of channels. In this case, the following applies to a transient time $t_1$ of the first partial quantity of exhaust gas and a transient time $t_2$ of the second partial quantity of exhaust gas:

$$t_{1/2} = \frac{L}{\int_0^L dz \frac{\partial v}{\partial z}}$$

with the velocity functions v(z) in each case being different for the two partial quantities of exhaust gas. This means that the first partial quantity of exhaust gas requires the time $t_1$ to flow through the first subset of channels, while the second partial quantity of exhaust gas requires the time $t_2$ to flow through the second subset of channels. If the following relationship applies to the transient time difference $t_1$-$t_2$, obtained as a result of flow through the two subsets of channels 5 and 8, between the two partial quantities of exhaust gas:

$$|t_1 - t_2| = \frac{2n+1}{2}\frac{\lambda}{c},$$

where n is an integer number, an additional phase factor is obtained. The overall wave equation can then be presented as:

$$\phi(z)=\exp(i\omega t_1+ikz)[A_1+A_2\exp(-i(2n+1)\pi)]$$

where $\omega$ is the angular frequency of the wave and $A_1$ and $A_2$ are the amplitudes of the waves in the first and second partial quantities of exhaust gas. If the exhaust-gas stream 3 is divided into two equal partial quantities of exhaust gas, i.e. if $A_1=A_2$, the wave is completely eliminated. If the amplitudes $A_1$ of the first partial quantity of exhaust gas and $A_2$ of the second partial quantity of exhaust gas are not identical, the sound wave having the wavelength $\lambda$ and corresponding harmonics are at any rate attenuated. This fact can be utilized in the exhaust-gas stream 3 to attenuate not just sound waves of one wavelength, but rather sound waves of a plurality of wavelengths. For this purpose, the exhaust-gas stream is not just passed through two subsets of channels, but rather through correspondingly more subsets, the channels of which have to be constructed accordingly.

Figure 2:
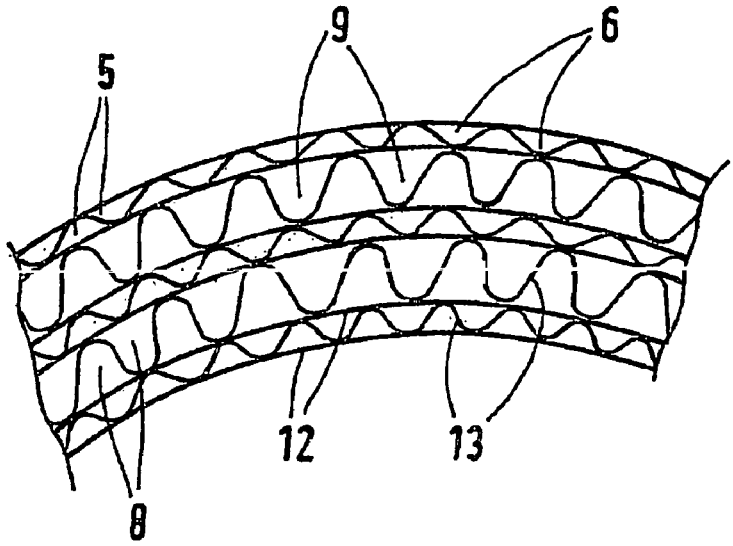
FIG. 2 is a fragmentary, end-elevational view of a first exemplary embodiment of a honeycomb body according to the invention.

FIG. 2 shows a portion of an end-elevational view of the inlet side 2 of one embodiment of a honeycomb body 1 according to the invention. This honeycomb body has a first subset of widening channels 5 and a second subset of narrowing channels 8. The widening channels 5 in each case have a first, smaller inlet cross-sectional area 6, while the narrowing channels 8 in each case have a second, larger inlet cross-sectional area 9. The change in cross-sectional area over the axial length L of the honeycomb body in this exemplary embodiment is strictly monotone in both subsets of channels. The honeycomb body is constructed of alternating smooth sheet-metal layers 12 and corrugated sheet-metal layers 13.

Figure 3:
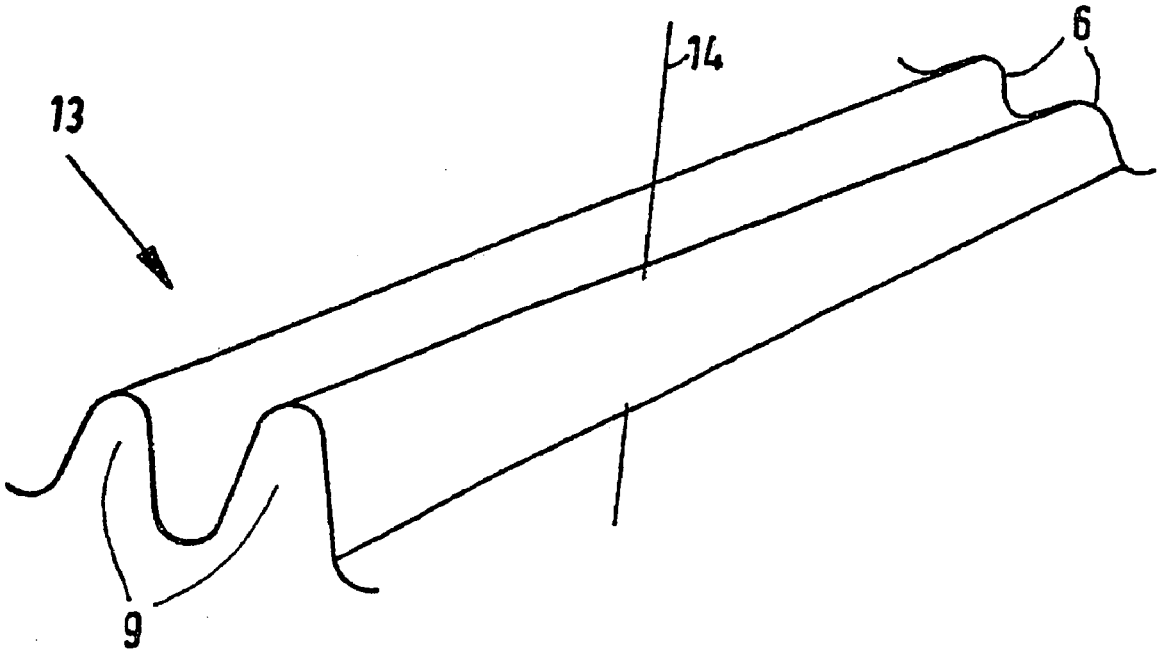
FIG. 3 is a perspective view of a corrugated layer used to produce the first exemplary embodiment of a honeycomb body according to the invention.

FIG. 3 shows an exemplary embodiment of a corrugated sheet-metal layer 13. The corrugation height of this corrugated sheet-metal layer 13 changes in strictly monotone fashion in the direction of the longitudinal axis, with the result that the cross-sectional area of the channels formed by the corrugated sheet-metal layer 13 together with an adjacent smooth sheet-metal layer 12 changes in strictly monotone fashion in the direction of the longitudinal axis. Its combination with an adjacent smooth sheet-metal layer 12 results on one side in channels with a first inlet cross-sectional area 6 and on the other side in channels with a second inlet cross-sectional area 9. If the honeycomb body is constructed in such a way that the corrugated sheet-metal layers 13 which adjoin a smooth sheet-metal layer 12 are in each case installed so as to be rotated through 180° in relation to one another with respect to a center axis 14, it is advantageously possible to construct a cylindrical honeycomb body 1 which has widening channels 5 and narrowing channels 8. The widening channels 5 and the narrowing channels 8 alternate in layers, and the cross-sectional area of the widening channels 5 increases in strictly monotone fashion from the first inlet cross section 6 to the first outlet cross section 7, whereas the cross-sectional area of the narrowing channels 8 decreases in strictly monotone fashion from the second inlet cross section 9 to the second outlet cross section 10. A honeycomb body 1 of this type, due to its layered structure including alternating widening channels 5 and narrowing channels 8, advantageously does not have any preferential direction with respect to its longitudinal axis, and consequently there is no need to observe a set installation direction when installing the honeycomb body 1.

Figure 4:
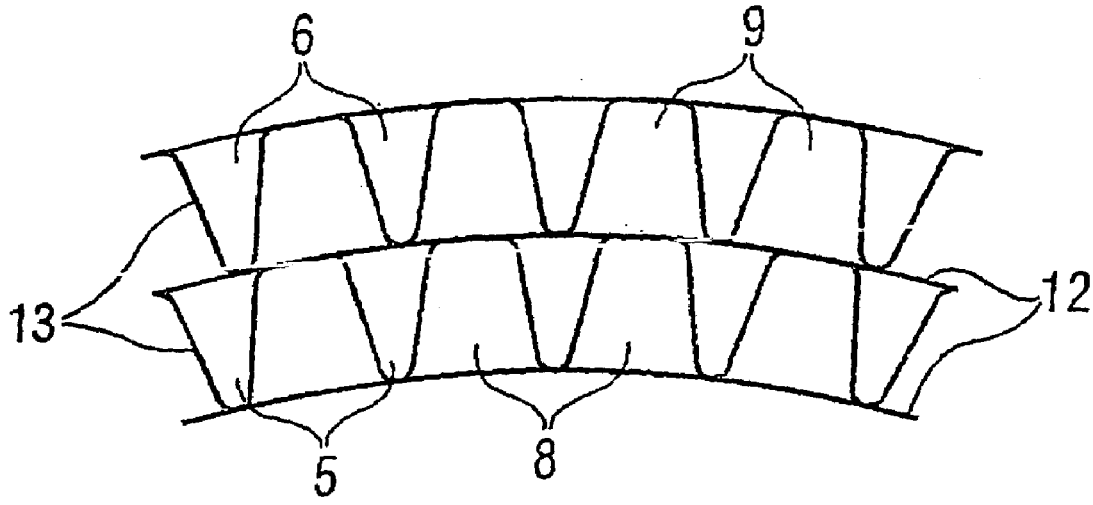
FIG. 4 is a fragmentary, end-elevational view of a second exemplary embodiment of a honeycomb body according to the invention.

FIG. 4 shows a portion of an end-elevational view of a second exemplary embodiment of a honeycomb body 6 according to the invention. The honeycomb body 6 is constructed from substantially smooth sheet-metal layers 12 and structured sheet-metal layers 13 and has a first subset of widening channels 5 and a second subset of channels forming narrowing channels 8. The widening channels 5 have a first inlet cross-sectional area 6. The widening of the widening channels 5 in the main direction of flow z increases the channel cross section in this direction. The narrowing channels 8 have a second inlet cross-sectional area 9. The channel cross section decreases in the direction of the main direction of flow z.

Figure 5:
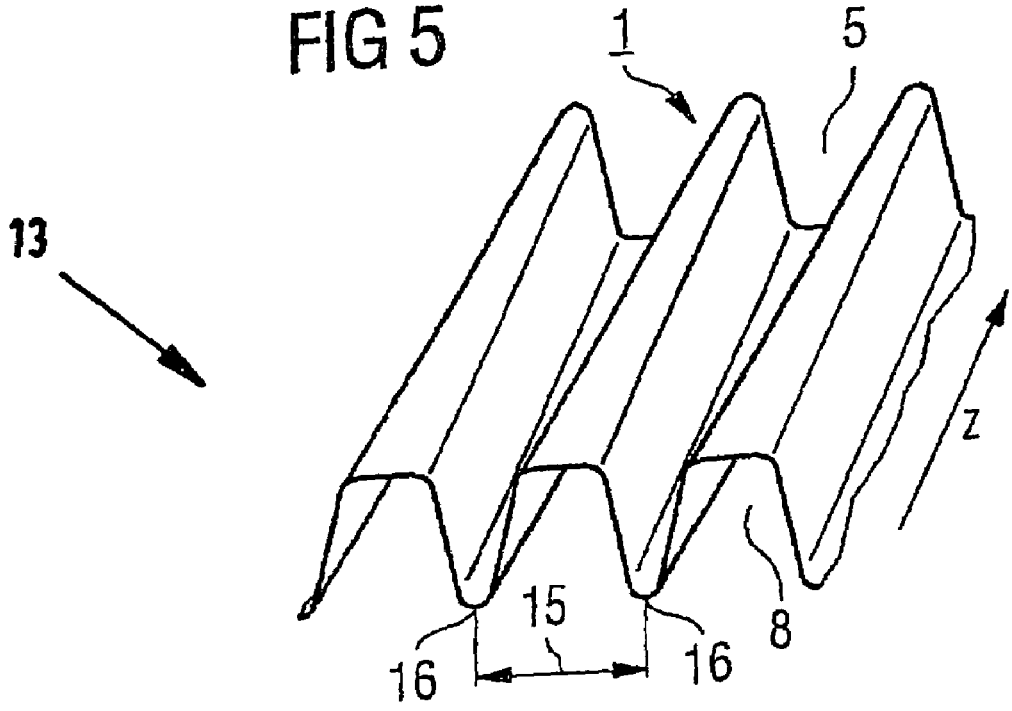
FIG. 5 is a perspective view of a structured sheet-metal layer for producing the second exemplary embodiment of a honeycomb body according to the invention.

FIG. 5 shows a structured sheet-metal layer 13, such as forms part of a honeycomb body shown in FIG. 4. This structured sheet-metal layer 13 is distinguished by the fact that a structure repeat length 15, which is defined as the distance between two adjacent structure maximums 16, changes continuously over the main direction of flow z, which is identical to the longitudinal axis of the structured sheet-metal layer 13. This leads to two subsets of channels formed by the structured sheet-metal layer 13 together with an adjacent, substantially smooth sheet-metal layer 12 which is not shown. One subset of channels is formed of narrowing channels 8, while the other subset of channels is formed of widening channels 5. As has been explained above, given a suitable configuration of the structured sheet-metal layers 13, this leads to attenuation of sound waves of at least one frequency.

The invention makes it possible to use existing honeycomb bodies in a simple way in the exhaust system for targeted sound muffling as an additional feature.

I claim:

1. A honeycomb body for an exhaust system of an internal combustion engine, the honeycomb body comprising: an axial length having a first end and second end opposite said first end; channels through which exhaust gas can flow, said channels being substantially separate from one another, each of said channels extending from said first end to said second end and opening at both of said ends, the exhaust gas flowing through said channels in a main direction of flow; said channels including at least a first subset of channels and a second subset of channels, and at least one of said subsets of channels having cross-sectional areas changing over said axial length, causing a transient time of the exhaust gas to be different in said first and second subsets of channels, said cross-sectional area of at least one of said subsets of channels decreasing in said main direction of flow.

2. The honeycomb body according to claim 1, wherein: said cross-sectional areas include a first inlet cross-sectional area and a first outlet cross-sectional area of said first subset of channels, and a second inlet cross-sectional area and a second outlet cross-sectional area of said second subset of channels; and a ratio of said first inlet cross-sectional area to said first outlet cross-sectional area is different than a ratio of said second inlet cross-sectional area to said second outlet cross-sectional area.

3. The honeycomb body according to claim 1, wherein: said cross-sectional area of at least another of said subsets of channels increases in said main direction of flow.

4. The honeycomb body according to claim 3, wherein said cross-sectional area of said at least one of said subsets of channels decreases in monotone fashion and said cross-sectional area of said at least other of said subsets of channels increases in monotone fashion.

5. The honeycomb body according to claim 3, wherein said cross-sectional area of said at least other of said subsets of channels increases in monotone fashion.

6. The honeycomb body according to claim 1, wherein said cross-sectional area of said at least one of said subsets of channels decreases in monotone fashion.

7. The honeycomb body according to claim 1, wherein at least one of said subsets of channels widens conically and at least another of said subsets of channels narrows conically.

8. The honeycomb body according to claim 1, wherein at least one of said subsets of channels widens conically.

9. The honeycomb body according to claim 1, wherein at least one of said subsets of channels narrows conically.

10. The honeycomb body according to claim 1, wherein said cross-sectional areas of said first and second subsets of channels have differing integrals over said axial length.

11. An exhaust system of an internal combustion engine, the exhaust system comprising: at least one honeycomb body having channels through which exhaust gas can flow and having an axial length with a first end and second end opposite said first end, each of said channels extending from said first end to said second end and opening at both of said ends, the exhaust gas flowing through said channels in a main direction of flow; said channels including a first subset of channels and a second subset of channels, said first subset of channels forming a flow path for a first partial quantity of the exhaust gas, and said second subset of channels forming a flow path for a second partial quantity of the exhaust gas; and at least one of said first and second subsets of channels having cross-sectional areas changing over said axial length of said at least one honeycomb body, causing a transient time of the exhaust gas to be different in said first and second subsets of channels, said cross-sectional area of at least one of said subsets of channels decreasing in said main direction of flow.

12. The exhaust system according to claim 11, wherein: said cross-sectional areas include a first inlet cross-sectional area and a first outlet cross-sectional area of said first subset of channels, and a second inlet cross-sectional area and a second outlet cross-sectional area of said second subset of channels; and a ratio of said first inlet cross-sectional area to said first outlet cross-sectional area is different than a ratio of said second inlet cross-sectional area to said second outlet cross-sectional area.

13. The exhaust system according to claim 11, wherein: said cross-sectional area of at least another of said subsets of channels increases in said main direction of flow.

14. The exhaust system according to claim 13, wherein said cross-sectional area of said at least one of said subsets of channels in decreases in monotone fashion and said cross-sectional area of said at least other of said subsets of channels increases in monotone fashion.

15. The exhaust system according to claim 13, wherein said cross-sectional area of said at least other of said subsets of channels increases in monotone fashion.

16. The exhaust system according to claim 11, wherein said cross-sectional area of said at least one of said subsets of channels decreases in monotone fashion.

17. The exhaust system according to claim 11, wherein at least one of said subsets of channels widens conically and at least another of said subsets of channels narrows conically.

18. The exhaust system according to claim 11, wherein at least one of said subsets of channels widens conically.

19. The exhaust system according to claim 11, wherein at least one of said subsets of channels narrows conically.

20. The exhaust system according to claim 11, wherein said cross-sectional areas of said first and second subsets of channels have differing integrals over said axial length.

21. A method for muffling sound in an exhaust system of an internal combustion engine, the method which comprises: providing the exhaust system with at least one honeycomb body having an axial length with a first end and second end opposite said first end and having first and second subsets of channels through which the exhaust gas can flow, each of said channels extending from said first end to said second end and opening at both of said ends; passing a first partial quantity of the exhaust gas through the first subset of channels and passing a second partial quantity of the exhaust gas through the second subset of channels; providing at least one of the first and second subsets of channels with cross-sectional areas changing over the axial length of the honeycomb body, resulting in a difference in transient time of the exhaust gas in the first and second subsets of channels; providing at least one of the subsets of channels with a cross-sectional area decreasing in a main direction of flow; and combining the partial quantities of the exhaust gas again downstream of the at least one honeycomb body.

22. The method according to claim 21, which further comprises: providing the first subset of channels with a first inlet cross-sectional area and a first outlet cross-sectional area; providing the second subset of channels with a second inlet cross-sectional area and a second outlet cross-sectional area; and setting a ratio of the first inlet cross-sectional area to the first outlet cross-sectional area to be different than a ratio of the second inlet cross-sectional area to the second outlet cross-sectional area.

23. The method according to claim 22, which further comprises selecting the difference in the transient time of the partial quantities of the exhaust gas to cause an at least partially destructive interference for at least one frequency when the at least two partial quantities are combined.

24. The method according to claim 23, which further comprises causing the at least partially destructive interference to occur for a critical frequency.

25. The method according to claim 22, which further comprises selecting the difference in the transient time of the partial quantities of the exhaust gas to cause an at least partially destructive interference for at least two frequencies when the at least two partial quantities are combined.

26. The method according to claim 21, which further comprises: providing at least another of the subsets of channels with a cross-sectional area increasing in the main direction of flow.

27. The method according to claim 26, wherein the cross-sectional area of at least the one subset of channels decreases in monotone fashion, and the cross-sectional area of at least the other subset of channels increases in monotone fashion.

28. The method according to claim 26, wherein the cross-sectional area of the at least other subset of channels increases in monotone fashion.

29. The method according to claim 21, wherein the cross-sectional area of the at least one subset of channels decreases in monotone fashion.

30. The method according to claim 21, which further comprises passing the exhaust gas through at least one of the subsets of channels widening conically and at least another of the subsets of channels narrowing conically, in the at least one honeycomb body.

31. The method according to claim 21, which further comprises passing the exhaust gas through at least one of the subsets of channels widening conically, in the at least one honeycomb body.

32. The method according to claim 21, which further comprises passing the exhaust gas through at least one of the subsets of channels narrowing conically, in the at least one honeycomb body.

33. The method according to claim 21, wherein the cross-sectional areas of the first and second subsets of channels have differing integrals over the axial length.

* * * * *